United States Patent [19]

Deering et al.

[11] Patent Number: 4,523,979

[45] Date of Patent: Jun. 18, 1985

[54] APPARATUS FOR RECOVERY OF RETORTED SHALE FROM AN OIL SHALE RETORTING PROCESS

[75] Inventors: Roland F. Deering, Brea; John H. Duir, Yorba Linda, both of Calif.

[73] Assignee: Union Oil Company of California, Los Angeles, Calif.

[21] Appl. No.: 569,237

[22] Filed: Jan. 9, 1984

Related U.S. Application Data

[60] Division of Ser. No. 454,836, Dec. 30, 1982, Pat. No. 4,446,001, which is a continuation-in-part of Ser. No. 451,597, Dec. 20, 1982, Pat. No. 4,435,271.

[51] Int. Cl.[3] ..... C10B 49/00

[52] U.S. Cl. ..... 202/99; 201/31; 201/32; 202/120; 202/208; 202/221; 202/262; 208/8 R; 208/11 R

[58] Field of Search ..... 202/99, 120, 221, 208, 202/262; 208/11 R, 8 R; 201/31, 32, 16; 406/136, 197

[56] References Cited

U.S. PATENT DOCUMENTS

| | | | |
|---|---|---|---|
| 2,783,898 | 3/1957 | Ardern et al. . | |
| 2,966,446 | 12/1960 | Deering . | |
| 3,004,898 | 10/1961 | Deering . | |
| 3,361,644 | 1/1968 | Deering . | |
| 3,501,394 | 3/1970 | Lyons . | |
| 3,976,558 | 7/1984 | Hall | 201/31 |
| 4,003,797 | 1/1977 | Cheadle et al. . | |
| 4,004,982 | 1/1977 | Jennings et al. . | |
| 4,010,092 | 3/1977 | Deering . | |
| 4,043,897 | 8/1977 | Deering . | |
| 4,069,132 | 1/1978 | Deering . | |
| 4,083,770 | 4/1978 | Deering . | |
| 4,141,794 | 2/1979 | Choi . | |
| 4,273,617 | 6/1981 | Goedde et al. . | |
| 4,288,294 | 9/1981 | Velling . | |
| 4,312,740 | 1/1982 | Chiaramonte . | |
| 4,336,126 | 6/1982 | Bertelsen . | |
| 4,336,127 | 6/1982 | Bertelsen . | |
| 4,435,271 | 3/1984 | Deering et al. . | |
| 4,448,668 | 5/1984 | Deering . | |
| 4,461,673 | 7/1984 | Deering et al. . | |

OTHER PUBLICATIONS

"Premium Syncrude from Oil Shale Using Union Oil Technology", by Miller, Harvey and Hunter, prepared for the 1982 National Petroleum Refiners Association Annual Meeting held Mar. 21 to 23, 1982, at San Antonio, Texas.

"Synthetic Crude Oil and Transportation Fuels from Oil Shale", by Randle and Kelley, prepared for the 46th Midyear Meeting of the American Petroleum Institute's Refining Department, held May 11 to 14, 1981, in Chicago, Ill.

*Primary Examiner*—Jay H. Woo
*Assistant Examiner*—Mike McGurk
*Attorney, Agent, or Firm*—June M. Bostich; Gregory F. Wirzbicki; Dean Sandford

[57] ABSTRACT

Retorted shale particles are recovered from a retort and delivered to a gas lift for transport to a fluidized combustor by passage, serially, through a sealing vessel, a crusher preferably operating at retort pressure, and a surge vessel. In the sealing vessel, a sealing gas is introduced, and after commingling with the shale, the gas passes countercurrently to the shale and enters the retort, thus sealing the retort gases in the retort while separating the retorted shale from the retort gases. Retorted shale from the sealing vessel is transported to a crusher, wherein the shale is reduced in size to that suitable for combustion under fluidized conditions. To prevent the crushed shale from packing, the shale is passed to a surge vessel, wherein the crushed shale is held as a fluidized bed, from which the crushed shale is continuously withdrawn at a regulated rate and introduced into the gas lift leading to the fluidized combustor.

11 Claims, 1 Drawing Figure

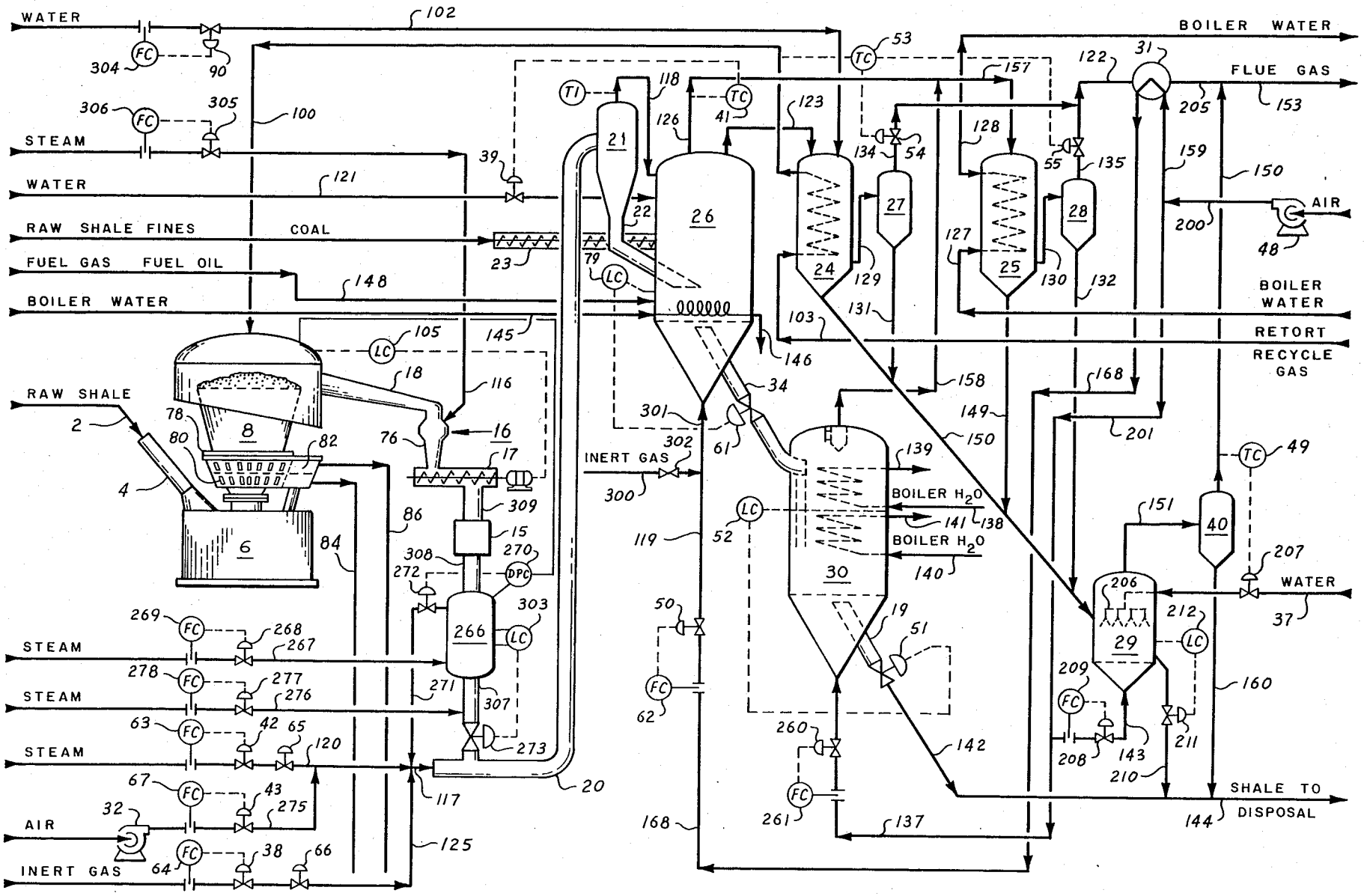
BOILER WATER
FLUE GAS
AIR
BOILER WATER
RETORT
RECYCLE GAS
WATER
SHALE TO DISPOSAL
BOILER H2O
BOILER H2O
INERT GAS
WATER
STEAM
WATER
RAW SHALE FINES
FUEL GAS
FUEL OIL
BOILER WATER
COAL
RAW SHALE
STEAM
STEAM
STEAM
AIR
INERT GAS

APPARATUS FOR RECOVERY OF RETORTED SHALE FROM AN OIL SHALE RETORTING PROCESS

CROSS-REFERENCE TO RELATED APPLICATIONS

This application is a divisional of U.S. patent application Ser. No. 454,836, filed Dec. 30, 1982, now U.S. Pat. No. 4,446,001 entitled "RECOVERY OF RETORTED SHALE FROM AN OIL SHALE RETORTING PROCESS," which is a continuation-in-part of U.S. patent application Ser. No. 451,597, filed on Dec. 20, 1982, now U.S. Pat. No. 4,435,271 entitled "OIL SHALE RETORTING PROCESS AND SEALING APPARATUS THEREFOR."

BACKGROUND OF THE INVENTION

This invention relates to retorting processes for recovering product hydrocarbons from oil shale and other hydrocarbon-bearing solids. The invention most particularly relates to those oil shale retorting processes wherein coke on the retorted shale is combusted to provide heat energy.

Many methods for recovering oil from oil shale have been proposed, nearly all of which utilize some method of pyrolytic eduction commonly known as retorting. To be competitive with the production of oils from petroleum stocks, the principal difficulty to be overcome has been recovering essentially all heat value from carbonaceous material in the shale without incurring prohibitive expense or environmental damage. Since shale usually contains only about 20 to 80 gallons of oil per ton, only a limited proportion of which can be recovered as product oil or gas, economical retorting must utilize remaining heat energy contained in the shale to provide heat for pyrolitic eduction. However, sulfur emissions in flue gases released from the retorting process must be restricted to the low levels required by law while this goal is being attained.

It is known to retort oil shale by a technique of contacting up-flowing oilbearing solids with down-flowing gases in a vertical retort, and one such technique is disclosed in U.S. Pat. No. 3,361,644. To educe product vapors, the upward-moving bed of shale particles exchanges heat with a down-flowing, hydrocarbonaceous and oxygen-free eduction gas of high specific heat introduced into the top of the retort at about 950° to 1200° F. In the upper portion of the retort, the hot eduction gas educes hydrogen and hydrocarbonaceous vapors from the shale and, in the lower portion, preheats the ascending bed of particles to retorting temperatures. As preheating continues, the eduction gas steadily drops in temperature, condensing high boiling hydrocarbonaceous vapors into a raw shale oil product while leaving a product gas of relatively high BTU content. The shale oil and product gas are then separated, and a portion of the product gas, after being heated, is recycled to the top of the retort as the eduction gas.

To minimize the volume of the recycle gas required, up-flow retorting is usually conducted with superatmospheric pressures, with the pressure in the upper regions of the retort often being between 10 and 50 p.s.i.g. However, means must be provided for introducing and recovering granular shale from the superatmospheric retorting zone without allowing valuable product and recycle gases to depressure. Conventional methods for achieving these objectives use elaborate lock vessels, valves, star feeders, or slide valves, which tend to wear rapidly and produce excessive fines through abrading the shale. Alternatively liquid sealing devices, as in U.S. Pat. No. 4,004,982 have been employed, which operate by moving shale particles through a standing head of oil or water, thereby creating a positive back pressure to forestall escape of retort gases. Liquid seals effectively contain retort gases but leave the shale wet. When incorporated into a process for combusting retorted shale in a vessel separate from the retort, as is conventional, use of liquid seals requires the expense of drying the shale prior to combustion.

To increase product yield beyond what can be educed in the retort alone, processes have been developed to generate product gases by reaction of hot, retorted shale with an oxidizing gas stream, for example, as taught in U.S. Pat. No. 4,010,092. However, such gasification reactions conducted in an oxidizing environment burn the coke on retorted shale at temperatures high enough to release significant amounts of carbon dioxide from decomposing carbonates in the shale, thereby necessitating expensive removal of carbon dioxide from combustible product gases.

Retorted shale contains heat value in the form of coke, and many retorting processes pass retorted shale particulates through a combustion zone to combust the coke and thus recover heat energy. However, because retorted shale generally contains sulfur components, less than complete combustion of the coke generates hydrogen sulfide, which must be removed from flue gases by means of costly sulfur recovery processes. On the other hand, complete combustion may result in flue gases containing unacceptable amounts of sulfur dioxide. To solve the problem of sulfur dioxide production during complete combustion, U.S. Pat. No. 4,069,132 discloses a combustion process wherein the sulfur dioxide generated during the combustion of coke on the retorted shale is converted to stable inorganic salts by reaction with alkaline ingredients of the shale. This process utilizes a combustor through which hot retorted shale gravitates cocurrently with air for combustion diluted by sufficient flue gas to control peak combustion temperature below 1670° F. Under such conditions, the discharge of sulfur dioxide from the combustor is disclosed to be greatly minimized.

Because flue gases from combustion zones associated with shale retorts are usually at high temperature, many retorting processes recover heat therefrom. For example, as taught in U.S. Pat. No. 4,069,132, the hot flue gases may be utilized to exchange heat indirectly with boiler feedwater to generate process steam.

While the aforementioned features have met with some success, the need exists for further developments in shale retorting processes. For example, the need exists for a process by which retorted shale can be removed from a retort operating at superatmospheric pressure without loss of retort gases, crushed to a size suitable for combustion under fluidized conditions while still at substantially retort pressure, and held under elevated pressure without packing prior to delivery to a desired location.

Accordingly, a principal object of this invention is to provide a process and apparatus for removing retorted shale particles from an oil shale retort while sealing the retort gases therein, subsequently crushing the shale under elevated pressure to a size suitable for fluidization, and subsequently holding the crushed shale as a bed without packing.

It is another object of the invention to integrate the foregoing process and apparatus into an overall process for retorting oil shale, recovering the retorted shale, combusting residual coke on the retorted shale under fluidized conditions, and, optionally, recovering a relatively large amount of heat derived from the combustion of the coke.

It is a further object to provide the foregoing overall process while also combusting the residual coke under conditions minimizing the production of sulfur compounds and/or nitrogen oxides.

It is a further object to provide a novel method and apparatus for recovering retorted shale particles from an oil shale retort in an essentially dry, finely crushed condition.

Yet another object of this invention is to provide a novel method for transferring crushed oil shale from a retort to a fluidized bed combustor where the combustor operates at a pressure either higher or lower than the retort.

These and other objects of the invention will be more apparent in light of the following description and the appended claims taken in conjunction with the drawing.

SUMMARY OF THE INVENTION

Briefly, in the present invention, particles containing combustible materials, usually in the form of a moving bed, are removed from a retort, such as an oil shale retort wherein shale vapors are educed from oil shale particles by pyrolysis, and passed through (1) a sealing vessel wherein a sealing gas flows countercurrently to the moving bed into the retort, thus sealing the gases therein, (2) a crusher for crushing or grinding the particles to a size suitable for fluidization with a gas stream, and (3) a surge vessel in which the moving particle bed is held as a fluidized bed under substantially non-combustive conditions.

In a typical embodiment of the present invention, shale particles are removed in a retorted condition from an oil shale retort, and particularly from a retort operating at superatmospheric pressure, and passed through a sealing vessel wherein a sealing gas is introduced and passed countercurrently to the shale particles into the retort, thus preventing loss of retort gases and sealing the retort. The retorted shale, now separated from the retort gases, is carried from the sealing vessel with the second portion of the sealing gas to a crusher for reducing the shale particles to a size suitable for fluidization, with the crushing preferably being accomplished under an operating pressure substantially equal to that prevailing in the retort at the point where the retorted shale is removed. After crushing, the shale particles and second portion of the sealing gas are transported to a surge vessel wherein, to avoid packing of the crushed shale while being held as a bed, the shale particles are maintained in a fluidized condition. Such fluidized conditions are maintained through use of a fluidizing gas stream, which ultimately commingles with the second portion of the sealing gas, and the commingled gases are then recovered. Meanwhile, the crushed shale particles, by being held in a fluidized state, are in a form for ready delivery elsewhere, as for example, to a fluidized combustor via a gas lift employing a carrier gas to transport the shale particles in an entrained form from the surge vessel to the combustor, in which the heat value in coke materials on the retorted shale is released by combustion.

In another embodiment of the invention, an overall process is provided wherein oil shale is retorted to produce shale oil, and the resulting retorted shale is recovered and subjected to combustion under fluidizing conditions as described above, but with the additional provision of a high recovery of the heat energy released during the combustion operation. This provision is accomplished by dividing the flue gases produced in the fluidized combustor in two, using the first portion indirectly to preheat eduction gases used in the oil shale retort, and using the second for indirectly heating water for such purposes as steam generation. This embodiment may be made yet more advantageous by transferring residual heat energy remaining in the first and second portions of the flue gas after the foregoing heat exchanges (i.e., preheating eduction gases and heating water) to the fluidizing gas stream employed to maintain fluidizing conditions in the combustor. This embodiment may be made still more advantageous by indirectly transferring heat energy contained in the hot shale particles after combustion to water, again for purposes such as steam generation.

In addition, the invention provides for the fluidized combustion to be achieved under conditions minimizing the production of gaseous sulfur compounds and/or nitrogen oxides to the environment. The production of gaseous sulfur compounds, such as $SO_2$, is minimized by controlling the combustion temperature below 1700° F., and the amount of nitrogen oxides produced is minimized by using minimum excess air for combustion.

BRIEF DESCRIPTION OF THE DRAWING

The drawing depicts a flowsheet of the process of the invention, including the preferred embodiment thereof. It will be understood, however, that for the sake of simplicity, and in keeping with the usual purpose of a flowsheet, a number of conventional items, such as pumps, compressors, and other equipment which themselves form no part of the invention nor aid in its description have been omitted.

DETAILED DESCRIPTION OF THE INVENTION

Any of a large number of naturally occurring oil-producing solids, and particularly those known as oil shale, may be used as feed materials in this process. The characteristics of these materials are generally well known and hence need not be described in detail. For practical purposes, however, the raw shale should be capable of yielding at least about 10, preferably at least 20, and usually between about 20 and about 80 gallons of oil per ton of raw shale by Fischer assay. The shale should be crushed to produce a raw shale feed having no particles greater than 6 inches and preferably none greater than 3 inches mean diameter. Average particle sizes of ⅛-inch to about 2 inches mean diameter are preferred.

Referring now to the drawing, raw crushed oil shale is fed at 2 into hopper 4 associated with a shale feeder within retort housing 6. The shale feeder forces the shale particulates upwardly into retort 8 at a rate which will vary considerably depending upon the size of the retort, the desired holding time therein, and the feeder selected for use. The shale feeder may be of any suitable design, for example, as shown in U.S. Pat. No. 3,361,644 herein incorporated by reference in its entirety.

Retorting is accomplished in retort 8 in a manner similar to that described in U.S. Pat. No. 3,361,644. The raw shale passes upwardly through retort 8, traversing a lower preheating zone and an upper retorting (or pyrolysis) zone. Temperatures in the lower portion of the retort are sufficiently low to condense product oil vapors from the superjacent retorting zone. As the shale progresses upwardly through the retort, its temperature is gradually increased to retorting levels by countercurrently flowing eduction gases comprising a preheated recycle portion of retort product gas from conduit 100. This product gas, and hence also the recycle gas, are of high BTU content, generally between about 700 and 1,000 BTU/Ft$^3$, and also of high specific heat, usually between about 14 and 18 BTU/mole/°F. Eduction temperatures are conventional, usually in excess of about 600° F., and preferably between 900° and about 1200° F. Essentially all of the oil will have been educed from the shale by the time it reaches a temperature of about 900° F. Gas temperatures above about 1300° F. in the eduction zone should not be exceeded since excessive shale oil cracking will result. Other retorting conditions include shale residence times in excess of about 10 minutes, usually about 30 minutes to about one hour, sufficient to educe the desired amount of oil at the selected retort temperatures. Shale feed rates usually exceed about 100, and are preferably between about 400 and about 2,000 pounds per hour per square foot of cross-sectional area in the retort. These values refer to average cross-sectional areas in the tapered retort illustrated in the drawing.

Pressure in retort 8 may be either subatmospheric, atmospheric, or superatmospheric, but normally the retorting pressure exceeds about 0.3 p.s.i.a., usually about 5 to 100 p.s.i.a., preferably about 25 to about 65 p.s.i.a., and typically about 25 p.s.i.a. The recycle gas is introduced via line 100 at a temperature and flow rate sufficient to heat the crushed shale to retorting temperatures. Heat transfer rates depend in large part on the flow rate, temperature, and heat capacity of this recycle gas. Flow rates of at least about 3,000, generally at least about 8,000, preferably between about 10,000 and about 20,000, and typically about 14,000 SCF of recycle gas per ton of raw shale feed are employed. The temperature differential between the recycle gas and solids at the top of the retorting zone is usually between 10° and 100° F. Excessive temperature differentials, e.g., in excess of about 400° F., should be avoided to prevent thermal stress in the metal of the retort.

As the recycle gas from conduit 100 passes downwardly through retort 8, it continuously exchanges heat with the upwardly moving oil shale. In the upper portion of retort 8, hydrocarbon materials contained within the oil shale are educed therefrom by pyrolysis, producing shale oil vapors and fuel gases comprising such normally uncondensable gases as methane, hydrogen, ethane, etc. These shale oil vapors and fuel gases pass downwardly with the recycle gas, firstly into the lower portion of retort 8 wherein the cool oil shale condenses the shale oil vapors, and thence into a frusto-conical product disengagement zone 78. This disengagement zone comprises peripheral slots 80 through which liquid shale oil and product vapors flow into surrounding product collection tank 82. The liquid shale oil is withdrawn therefrom, usually at a rate between about 5 and 60 gallons/ton of raw shale feed via conduit 84, while the aforementioned product vapors at a temperature between about 80° and 300° F. are withdrawn via conduit 86.

After retorting, the shale particles, now at an elevated temperature, e.g., between about 900° and 1000° F., are removed from the upper portion of retort 8. To transfer and prepare the retorted shale for fluidized combustion without substantial loss of heat, the retorted particles pass in series and in vertical alignment through (1) a recovery means of practical height for removing the shale particles from the retort without substantial loss of pressure and without substantial loss of retort gases, (2) a crusher to reduce the retorted shale particulates under substantially retorting pressure to a size suitable for fluidization, and (3) a transfer system to deliver the crushed particulates to a fluidized combustor that will not easily be plugged by crushed particulates. The drawing sets forth one combination of apparatus between retort 8 and combustor 26 to achieve the foregoing objectives, said apparatus being comprised of bustle ring 16, crusher 15, surge vessel 226, solids flow control valve 273, gas lift 20, and cyclone separator 21, along with the conduits leading therebetween. In the actual practice of this invention, however, several such combinations may operate in parallel, for example, between two and ten such combinations. In the preferred embodiment, four combinations of apparatus operating with the flow rates hereinafter specified are used to transfer shale from retort 8 to combustor 26.

The shale particles flow by gravity from retort 8 serially through chute 18, a sealing vessel such as bustle ring 16, and standpipe 76 while being partially stripped of hydrocarbonaceous residue and other combustibles by a gas stream comprising an inert gas. More preferably, during gravitation the shale particles react with or are stripped by a gas stream comprising steam introduced into bustle ring 16 via conduit 116 at a rate controlled by control valve 305 in response to flow controller 306. The gas stream typically (although not necessarily) divides into two gas streams. The first stream, at a rate of between 300 and 1,000 lb/hr., and preferably at about 500 lb/hr., flows countercurrently to the retorted shale particles into retort 8, carrying with it any product gases freed by stripping or generated by reaction of the combustibles with steam for recovery with other retort product gases. The second stream, at a rate usually between 0 and 500 lbs/hr., generally from about 50 to about 500 lbs/hr., and preferably at about 200 pounds per hour, flows co-currently with the gravitating retorted shale particles into conduit 17. Means for transporting solids, such as a vibrating feeder, or preferably a screw conveyor housed within conduit 17, transports the shale particles into standpipe 309 and then into crusher 15 while also allowing the second gas stream to pass into crusher 15. The rate of solids transfer is controlled by response of the drive mechanism on the feeder within conduit 17 to level controller 105, which is adapted to ensure that a continuous column of retorted shale moves through chute 18, bustle ring 16, and standpipe 76.

In crusher 15, the shale particles are reduced to a size usually no greater than ½ inch, and preferably to less than ¼ inch, and usually between about ⅛ and ¼ inch. The crusher itself may be any suitable device for reducing the size of particulate solids, preferably with a minimum of fines production, that is fluid-tight when operated at the desired pressure for crushing. Typical crushers suitable for use herein include toothed roll crushers, jaw crushers, cone crushers, and hammer crushers, with the hammer or roller variety being preferred for their usefulness in minimizing fines production, efficiency under pressurized conditions, and high capacities relative to the size of the machines.

The crusher may operate at any desired pressure that does not cause mechanical breakdown, but preferably pressure in the crusher is substantially that of the retort. Since the preferred retorting pressure is superatmospheric, pressure in the crusher is therefore preferably also superatmospheric, usually greater than 15 p.s.i.g., for example, 15 to 25 p.s.i.g.

Once in a crushed form suitable for fluidization, transport of shale particles without packing is facilitated by recovery from crusher 15 through standpipe 308 into fluidized surge vessel 266 where the solids are maintained in a fluidized state by a gas stream introduced via conduit 267 into the lower region of surge vessel 266 at a rate determined by response of flow control valve 268 to flow controller 269, usually between 2,500 and 5,000 pounds per hour, and preferably about 3,500 pounds per hour. The fluidizing gas stream is comprised of inert gas or, more preferably, steam. In surge vessel 266 the second, downward flowing stream of stripping gas mingles with the fluidizing gas stream. In response to the operation of differential pressure controller 270 upon flow control valve 272, a first portion of these combined gases leaves surge vessel 266 via conduit 271, while the remaining second portion exits via standpipe 307 and solids flow control valve 273 with the crushed shale.

In the combination of apparatus between the retort and the combustor, pressures are balanced to assure that retort gases are sealed into the retort. The retort may operate at any pressure, but preferably the pressure of the retort is different than that of the combustor, and more preferably higher than that of the combustor and most preferably the pressure in the retort is superatmospheric, as above described, while that in the combustor is essentially atmospheric. In the preferred embodiment, the flow of the gas stream entering bustle ring 16 via conduit 116 is adjusted to maintain a pressure at the point of entry that is slightly higher than retort pressure, for example 0.1 to 3.0 inches of water higher than the retort, so as to assure division of the gas stream into two streams, the first flowing into the retort and the second flowing into the crusher as above described. The pressure in the upper region of surge vessel 266 is maintained slightly higher than that of the retort, for example 0.1 to 3.0 inches of water higher than the retort, but slightly lower than the pressure at the point of entry of conduit 116 into bustle ring 16, for example 0.1 to 3.0 inches of water lower than conduit 116. Differential pressure controller 270 measures the differential pressure between the retort and the upper region of surge vessel 266 and signals control valve 272 to adjust the rate of the gases leaving surge vessel 266 via conduit 271 as necessary to maintain the desired pressure in the upper region of surge vessel 266. It will be noted, of course, that flow controllers 269 and 278, if used, are set to maintain maximum flow rates of steam in conduits 267 and 276, respectively, but the ultimate control of the rates through these conduits is regulated by differential pressure controller 270 and control valve 272.

In an alternative embodiment, the pressure of the retort is lower than that of the combustor, for example, the retort may be at subatmospheric pressure while the pressure of the combustor is atmospheric or the retort may be at atmospheric pressure while the pressure of the combustor is superatmospheric. In these alternative embodiments, the pressures in retort 8, bustle ring 16 and surge vessel 266 are controlled relative to each other as described in the preferred embodiment above, except that to prevent the flow of gas from gas lift 20 into surge vessel 266, it is usually necessary to introduce a stream of fluidizing gas via conduit 276 into standpipe 307 with the bulk thereof flowing into surge vessel 266. Standpipe 307 must be of sufficient height to establish a head of pressure, with the fluidizing gas entering of conduit 276, slightly greater than the difference in the pressure between the stream of carrier gas entering gas lift 20 via conduit 117 and the pressure at the juncture of vessel 266 and standpipe 307. In these alternative embodiments, the gas stream leaving surge vessel 266 via conduit 271 is not directed into gas lift 20 but is sent to a condenser (not shown).

By way of standpipe 307, crushed particles, along with the remaining second portion of the mingled gases, gravitate from surge vessel 266 through a solids flow control valve 273, which is preferably a slide valve for gas-solids operation, at a rate controlled by level controller 303 to ensure a desired residence time within surge vessel 266, usually between 2 and 8 minutes, preferably about 5 minutes. From standpipe 307 and valve 273, the crushed particles and gases descend into the entrance of gas lift 20 for transport to combustor 26. If plugging occurs in standpipe 307, a gas stream comprised of inert gas or, more preferably steam, can be introduced via conduit 276 at a rate determined by control valve 277 in response to flow controller 278. Typically, gas flow in conduit 276 is used only for startup or to restart flow after a flow stoppage, or if one of the alternative embodiments is employed.

Solids flow control valve 273 reduces the pressure within the lower regions of surge vessel 266 to that prevailing in gas lift 20. The pressure at the top of the surge vessel is usually maintained slightly above that at the upper region of the retort to ensure a positive flow of steam into the retort, thereby sealing retort vapors within the retort.

Upon entry into the gas lift, the crushed shale particles are swept upwards by air from blower 32 via conduit 275. The air enters the lift flowing upwards at a velocity and pressure sufficient to elevate the crushed shale particles to the entrance of a cyclone separator 21 or other means for separating gases from particulate solids. Generally, a gas velocity of about 20 to about 150 feet per second, and preferably about 50 to 100 feet per second, and a blower discharge pressure of about 2 to about 10 p.s.i.g., and preferably 4 to 5 p.s.i.g., are employed. Usually, the air feed is controlled by control valve 43 responsive to flow controller 67 so as to enter gas lift 20 at a rate between about 1,000 and about 1,500 SCF per ton of shale introduced into the gas lift.

If desired, a portion of the air supplied to gas lift 20 in conduit 117 may be replaced with either steam from conduit 120 flowing through control valve 42 responsive to flow controller 63 or with inert gas from conduit 125 flowing through control valve 38 responsive to flow controller 64. In yet another embodiment, a mixture of air, steam, and inert gas is utilized. In the preferred embodiment, however, the gas used to replace a portion of the air issuing from control valve 43 leading to gas lift 20 is only the gas mixture leaving surge vessel 266 via conduit 271. To this end, hand-operated valves 65 and 66 are closed while control valves 42 and 43 are open.

The gas-particulate mixture sweeping upwards in gas lift 20 gradually increases in temperature due to partial combustion of coke in the crushed retorted shale, usually under net reducing conditions wherein no more than 30 percent, and typically no more than 20 percent, of the total air for combustion in conduits 168 and 275 combined is directed into the gas lift via conduit 117 while the remainder passes into combustor 26 via conduits 119 and 301. In the preferred embodiment of the invention, the gas lift temperature is controlled to a maximum selected value, usually between about 900° and 1600° F., as for example, 1000° F. The selected maximum gas lift temperature may be maintained using an appropriate temperature control scheme (not shown) wherein the air rate, inert gas rate, and steam rate are regulated by control valves 43, 38, and 42, respectively, in relation to the shale feed rate through solids flow control valve 273 so as to yield the desired maximum temperature at the top of gas lift line 20.

At the top of lift line 20, the crushed shale particles are separated from a gas stream in cyclone separator 21. The separated gas stream enters combustor 26 above the fluidized bed via conduit 118 while the crushed particles gravitate from the cyclone separator through chute 22 into the fluidized bed in combustor 26. In the preferred embodiment, the separated gas stream contains gaseous reaction products whose combustion will increase the thermal recovery and pollution control efficiencies of the overall process.

Because some sulfur components usually present in the retorted shale or in the coke contained therein are converted to one or more gaseous forms in gas lift 20, and because the preferred embodiment provides for introducing sulfur-containing gases (and particularly hydrogen sulfide) into gas lift 20 from surge vessel 266 via conduits 271 and 117, and also from standpipe 307, sulfur-containing gases will generally be present in the separated gases recovered in conduit 118. These sulfur-containing gases, due to the net reducing combustion conditions preferably maintained in gas lift 20, will largely be present as a mixture of hydrogen sulfide and sulfur dioxide, the latter forming either directly by combustion of gaseous sulfur components entering the gas lift or indirectly by combustion of sulfur-containing gases released from the shale particles in the gas lift. However, it should be noted that, during combustion in lift line 20 and gas separator 21, and more especially in combustor 26, sulfur-containing gases (and particularly the sulfur oxides) react with alkaline components of the retorted shale and remain therewith in a stable form so long as the operating temperature of the combustor is controlled as hereinafter described. Thus, although sulfur-containing gases are produced in the process of the invention, provision is made to remove essentially all of such components and thereby minimize sulfur emissions from the combustor while producing an environmentally safe, sulfur-containing shale ash.

Also contained in the separated gases in conduit 118 are fuel gases such as carbon monoxide, hydrogen, and hydrocarbonaceous gases, e.g., methane, ethane, and the like. Some of these gases are produced in bustle ring 16, standpipe 76, conduit 17, standpipe 309, crusher 15, standpipe 308, surge vessel 266, and standpipe 307 and enter gas lift 20 via standpipe 307 and, if the preferred embodiment is employed, via conduits 271 and 117. These fuels will usually be only partially consumed during combustion in the gas lift when net reducing conditions are employed. Since fuel gases may be released from the coke under net reducing conditions, the amount of fuel gases contained in the separated gas stream in conduit 118 may exceed that which entered the gas lift. In any event, the separated gas stream is preferably directed by conduit 118 to combustor 26 wherein any fuel gases are combusted to supply heat energy for the process of the invention while sulfur emissions are minimized as explained above.

In combustor 26, a fluidized combustion zone is maintained, the main purpose of which is to salvage heat energy from the coke still remaining in the shale particulates. Operating under fluidized combustion conditions allows for high combustion efficiency since the finely crushed particulates expose more coke than the larger-sized particulates recovered from the retort would and the high degree of turbulence maximizes the contacting efficiency between the coke in the crushed particulates and the gaseous oxygen required to support combustion. Yet another advantage of a fluidized combustor, since combustion efficiency is maximized, is that sulfur emissions during combustion are minimized.

Combustor 26 is preferably provided with a suitable vessel into which fuel sources such as raw shale fines, coal, or other crushed, particulate fuels may be introduced, as for example by means of screw conveyor 23. Other fuel sources are also provided for in the preferred embodiment, for example, fuel gas or fuel oil through conduit 148. Fuels from these sources are generally employed during start-up, but they may also be introduced if desired during normal operation. However, once normal operation (i.e., steady state) is achieved, the primary fuel in combustion vessel 26 will be the coke still remaining on the shale particulates introduced through chute 22.

Fluidized combustion conditions are achieved in the combustor by introducing air therein from blower 48 via conduits 200 and 159, heat exchanger 31, and conduits 168, 119, and 301 at a temperature (elevated by heat exchange in heater 31) and at a rate (controlled by operation of control valve 50 regulated by flow controller 62) so as to maintain combustion conditions and ensure fluidization of the largest particulates. Generally, these objectives are achieved by heating the air passing through heater 31 to a temperature between about 100° and about 800° F. by indirect heat exchange with flue gas and passing the air through the combustor at a linear velocity between about 2 and 15 feet per second, preferably between 3 and 6 feet per second and at a rate of about 10,000 to 20,000 SCF per ton, typically about 16,000 SCF per ton, of shale particulates carried in chute 22. Higher air rates may be necessary if fuel is also added via screw conveyor 23 or conduit 148.

Preferably, the combustion in combustor 26 is such as to derive the maximum amount of heat energy from the combustible materials introduced therein, the combustion usually being achieved under net oxidizing conditions with excess oxygen, preferably a minimum of excess oxygen (e.g., less than 1 percent, typically 0.1 to 0.2 percent) to minimize emissions of nitrogen oxides, for example, below 400 ppmv, and preferably below 300 ppmv. Typically, the combustion is at least sufficient to leave no more than 20 percent of the coke that was present on the shale when removed from retort 8 via conduit 18. Preferably, no more than 10 percent remains, and in the most preferred embodiment, no more than 5 percent remains.

Combustor 26 may be operated at any elevated temperature sufficient to promote combustion of coke on the crushed shale particles, but preferred operation is such that the peak temperature lies between about 1200° and about 1670° F., and most preferably between 1400° and 1650° F., as for example, 1550° F. Higher temperatures are generally avoided, because operation at temperatures in excess of about 1700° F. results in high level emissions of sulfur compounds from the combustor. On the other hand, combustion temperatures below about 1700° F., and particularly below about 1670° F., are such that gaseous sulfur components in combustor 26 will react essentially to completion with alkaline components in the particulate shale, and remain therewith.

To regulate the temperature in combustor 26 below a desired peak value, reliance is placed primarily on adjusting the air flow into the combustor as necessary using control valve 50, or more preferably by introducing via conduits 300 and 301 a flow of inert gas such as flue gas or steam by opening valve 302 on conduit 300 while controlling air flow to give minimum excess oxygen. However, advantage is also taken in combustor 26 of transferring heat to a steam generation system (shown only in relevant part in the drawing) using bed coils 44 and entrance and exit conduits 145 and 146. And in the event of overheating, water may be introduced directly into the combustor via conduit 121 using control valve 39 responsive to temperature controller 41 set at a predetermined maximum value, which value may, for example, be the maximum temperature desired in combustor 26 or the maximum safe operational temperature for combustor 26.

The hot flue gas produced in combustor 26 usually issues therefrom at a total flow rate generally between about 15,000 and about 35,000 SCF per ton, and typically about 22,000 SCF per ton, of shale introduced into combustor 26. Although this flue gas may be discharged from the combustor as a single flue gas stream followed by recovery of heat therefrom, in the practice of the present invention it is highly preferred that the flue gases be divided into two streams, from which heat recovery is accomplished for the threefold purposes of (1) controlling the temperature of the retorting gases in conduit 100, (2) aiding in the generation of steam by heating boiler water carried in conduit 127, and (3) preheating the air in conduit 159 for use subsequently in combustor 26 via conduits 119 and 301. Thus, in the preferred practice of the invention, a first flue gas stream flows from combustor 26 into conduit 123 at a rate ultimately regulated by control valve 54 responsive to "split range" temperature controller 53, with the rate generally being at between about 12,000 and about 25,000 SCF per ton, and typically about 16,000 SCF per ton of shale introduced into combustor 26. This first stream enters and traverses heat exchanger vessel 24, flows therefrom by conduit 129 to cyclone separator 27 or other means for separating gases from particulate solids, and is recovered in conduit 134 to be combined with other flue gases in conduit 122. The resultant gases are then passed into heat exchanger 31 for transfer of as much heat as possible to air carried in conduit 159, after which they are discharged by conduits 205 and 153 either directly to atmosphere or indirectly after treatment in a dust removal system such as a bag house (not shown). The second flue gas stream leaves combustor 26 via conduit 126 at a rate ultimately regulated by control valve 55 responsive to the "split range" temperature controller 53, the rate generally being between about 3,000 and 10,000 SCF per ton, and typically about 6,000 SCF per ton of shale entering the combustor. This second flue gas stream in conduit 126 is blended in conduit 157 with yet other flue gases carried by conduit 158 from cooling vessel 30; the blended gases so produced are introduced into heat exchanger 25 through conduit 157. After traversing heat exchanger 25 and exchanging heat with boiler water in the steam generation system, which boiler water enters the exchanger by conduit 127 and exits by conduit 128, the combined flue gases are carried by conduit 130 into cyclone separator 28, from which they are recovered through conduit 135 in an essentially particulate-free condition (containing only dust) for use in heat exchanger 31.

In addition to salvaging as much heat energy as possible from the flue gases in heat exchangers 24, 25, and 31, provision is also made to control the retorting temperature in retort 8 using heat energy generated in combustor 26 and recovered in heat exchanger 24. For this purpose, a retort gas stream 103, which is usually a portion of the retort gases recovered from the retort in conduit 86, often after treatment for removal of sulfur compounds and/or removal of entrained fines and oil droplets, is passed through heat exchanger 24 and therein heated from an initial temperature usually in the range of about 140° to 200° F. to a desired retorting temperature, the heated retort gas then being directed by conduit 100 to retort 8. The temperature to which the retort gas stream is heated is regulated by control valve 54, which controls the rate at which flue gas passes through the shell side of heater 24. Control valve 54 in turn is responsive to "split range" temperature controller 53, which measures the retort gas temperature in conduit 100 relative to a set point and appropriately adjusts the respective rates at which flue gases pass through control valves 54 and 55, so that the retort gas temperature in conduit 100 is maintained as closely as possible to the set point. Typically, the retort gas temperature is controlled to a temperature between about 900° and about 1050° F., and usually to about 1000° F., and should the temperature control system fail and an excessive temperature condition be encountered; quench water may be introduced into heater 24 via conduit 102 at a rate determined by control valve 90 in response to flow controller 304.

Also included in the preferred embodiment of the present invention is a system for collecting and treating fines carried from combustor 26 in the various flue gas streams. For this purpose a fines collection line 150 is provided to gather fines recovered from cyclone separators 27 and 28 via conduits 131 and 132, respectively. The fines collection line also gathers fines which gravitate directly thereinto from heat exchanger 24 and indirectly from heat exchanger 25 through conduit 149. Ultimately, therefore, all the fines produced in the process of the invention, save whatever residual portion in the form of dust is carried to the atmosphere or a bag house via conduit 153, are gathered in fines collection line 150.

The fines thus collected may be subjected to heat exchange, so as to recover as much energy as possible from the process. The heat exchange, of course, may be achieved through use of any of a number of heat exchange devices, such as rotary drum coolers, gravity coolers with indirect heat exchange and indirect screw coolers.

In the preferred practice, however, the heat energy in the fines is not recovered; instead, fines from collection line 150 are introduced into fines cooler 29 and therein cooled by evaporating water introduced directly onto the fines as a spray from distribution means 206, which draws water from conduit 37. Air is introduced into the fines cooler from conduits 200, 201, and 143 at a rate, regulated by control valve 208 responding to flow controller 209, sufficient to fluidize the fines within the fines cooler. Yet further enhancement is achieved by controlling the rate at which water is drawn through control valve 207 on conduit 37, in response to temperature controller 49 measuring temperature deviations in conduit 151 from a predetermined set point, such that all water introduced into the fines cooler is vaporized therein and recovered as a vapor with other gases in conduit 151. Operating in this manner provides for recovery, through conduits 210 and 144 as regulated by control valve 211 responsive to level controller 212, of decarbonized shale fines in an essentially moisture-free form suitable for transport to a disposal site. The fines are wetted in a controlled manner before disposal in a landfill site.

Meanwhile, the water-containing gas stream recovered from the fines cooler in conduit 151 is transported to cyclone separator 40, recovered therefrom in conduit 150, and combined with other gases in conduit 153 for bag house treatment or other means of dust removal. Also recovered from cyclone separator 40 are residual, decarbonized fines, which, being in an essentially moisture-free condition, are first collected in conduit 160 and then combined in conduit 144 with other particulates in a similar condition, after which the combined particulates are directed to a disposal site.

Returning now to combustor 26, provision is made in the invention for cooling and recovering heat from the residue shale ash. In the preferred embodiment, hot, decarbonized shale ash gravitates from combustor 26 through chute 34 into cooling vessel 30 for heat recovery and further combustion of coke, the rate of gravitation being controlled by control valve 61 in response to level controller 79, which establishes the requisite residence time for shale particles in the combustor. The bed of shale ash is maintained in a fluidized state by contact with a stream of air at ambient temperature entering from conduit 137 at a rate regulated by control valve 260 responsive to flow controller 261. In the upper regions of cooling vessel 30 the hot, fluidized particles generate steam through indirect heat exchange with circulating boiler water entering therein from conduit 138 and exiting via conduit 139. In the lower regions of cooling vessel 30, feedwater to a boiler of the steam generation system entering via conduit 140 and exiting via conduit 141 is preheated through heat exchange with the fluidized particles. As a result of heat recovery, the temperature of the shale ash drops from that in the combustor, usually about 1400° to 1700° F., to between about 300° and about 450° F. In the preferred embodiment, residence time in vessel 30 is sufficient to accomplish the above temperature drop while allowing for combustion of some or essentially all of the residual coke in the shale, usually between about 20 and about 40 minutes.

From the floor of cooling vessel 30, the shale ash empties by gravity through chute 19 into conduit 142, the rate of gravitation being controlled by control valve 51 in response to level controller 52. The cooled, decarbonized, essentially moisture-free ash in conduit 142 is combined with cooled shale fines from conduits 210 and 160, and the mixture is sent to disposal via conduit 144. A conventional system for controlled wetting (not shown) may form a part of the disposal system, for example, the decarbonized shale ash in conduit 144 may be sent through a pugmill and therein mixed with water so that it forms a cement.

In alternative embodiments, cooling and recovering heat from residue shale ash removed from the combustor may be accomplished by such equipment as rotary drum coolers, gravity coolers with indirect heat exchange, and indirect screw coolers.

The retorting process as above described offers several advantages, among which are maximum temperature control as well as minimum emissions of sulfur at all times, including start-up and shut-down. Retort temperature may be reduced to prevent excess cracking of product vapors and formation of clinkers by diverting a larger portion of the flue gases from combustor 26 to heat exchanger 25 for steam generation while reducing the flow to the recycle gas heater 24. Combustion temperature is decreased by sending into the combustor more fluidizing air, thereby safeguarding from thermal degradation the solid sulfur-containing products of combustion and, thus, minimizing sulfur emissions.

High efficiencies of heat recovery and combustion are additional features of this process. The heat recovery efficiency, which is often at least 50 percent, and usually in the range of about 50 to about 75 percent of the heat generated in the process, is combined with water requirements so minimal that the retorting process is feasible for use in areas where water is expensive or in short supply. High combustion efficiency, on the other hand, ensures maximum utilization of all the fuel in the shale while providing an essentially decarbonized and moisture-free shale ash that upon wetting spontaneously forms a permanently stable cement-like agglomerate suitable for revegetation in accordance with environmental regulation.

Yet another advantage of this process is that the shale is elevated to the combustor by means of a dilute-phase lift line. Bucket elevators or other mechanical lifting devices are not required.

A further advantage, and one of great importance, resides in the apparatus transporting the retorted shale between retort 8 and combustor 26, and more particularly between retort 8 and gas lift 20. Among other advantages, this apparatus provides for separation of the retorted shale from retort gases, for sealing the retort gases in the retort, for crushing of the shale under superatmospheric pressure, for generation of fuel gases, for recovery of the shale particles in a dry condition with little or no loss of heat, and most especially, for holding the finely crushed shale in a form preventing or minimizing packing problems while it is withdrawn at a regulated rate via solids control valve 273. This last advantage is achieved through fluidization in surge vessel 266, the absence of which, it should be noted, would result in packing to the point of plugging, due to the combined effects of superatmospheric pressure and gravity. In many instances, an elevated pressure alone or gravity alone would cause plugging, so that the importance of surge vessel 266 to reliable operation can be readily seen.

By comparison to other means for sealing a retort from the environment into which retorted shale particles are discharged, for example, lock hoppers or star valves, the present invention is mechanically simpler and requires less maintenance.

Although this invention has been described in conjunction with a preferred embodiment thereof, it is evident that many alternatives, modifications, and variations will be apparent to those skilled in the art in light of the foregoing description. For example, a variety of hydrocarbon-bearing particulates may be used in the process of the invention, including coal and lignite. Accordingly, it is intended to embrace this and all such alternatives, modifications, and variations that fall within the spirit and scope of the appended claims.

We claim:

1. An apparatus for recovering retorted shale particulates from an oil shale retort comprising, in combination and in fluid communication:

(1) an oil shale retort for retorting particulates of oil shale of at least ½ inch mean diameter, said retort operating at conditions of elevated pressure;

(2) a first vessel with an entrance opening and exit opening for a moving bed of particulates to pass therethrough, said vessel being further provided with means for introducing a gas thereinto under sufficient pressure to prevent flow of gases from the retort into said first vessel;

(3) means for transporting said retorted shale particulates from said retort into said first vessel through the entrance opening;

(4) means for crushing said particulates to a size less than ½ inch in diameter;

(5) means for transporting said particulates from said first vessel through the exit opening thereof to said crushing means;

(6) a second vessel provided with an entrance opening and exit opening for said moving bed of particulates, said vessel being further provided with means for introducing a gas thereinto at a rate sufficient to maintain said moving bed in a fluidized condition;

(7) means for transporting said particulates from said crushing means into said second vessel through the entrance opening;

(8) a combustor for combusting combustible materials upon said particulates under fluidized conditions and operating at a pressure lower than that of the retort;

(9) means for transporting said particulates from said second vessel to said combustor, said transporting means comprising means for introducing and transporting a gas at a sufficient rate to carry said particulates in an entrained form; and

(10) means for regulating the rate at which said particulates exit said second vessel through the exit opening thereof while simultaneously reducing the pressure of solids passing therethrough to that prevailing in said transporting means (9).

2. An apparatus as defined in claim 1 wherein said means for transporting said particulates to said combustor further comprises a cyclone separator for separating said particulates from said gas.

3. An apparatus as defined in claim 2 wherein elements (3) through (7) are in essentially vertical alignment.

4. The apparatus defined in claim 1 wherein the retort is an upflow retort.

5. The apparatus defined in claim 1 wherein the means for introducing a gas into the first vessel is adapted to pass at least a portion of the gas through transporting means (3) countercurrently to the retorted shale particulates entering the first vessel and into the retort.

6. The apparatus defined in claim 1 wherein crushing means (4) is adapted to operate at elevated pressure.

7. The apparatus defined in claim 6 wherein crushing means (4) is a hammer crusher.

8. The apparatus defined in claim 6 wherein crushing means (4) is a roller crusher.

9. The apparatus defined in claim 1 wherein regulating means (10) comprises a solids flow control valve.

10. The apparatus defined in claim 9 wherein regulating means (10) comprises a slide valve for gas-solids operation.

11. The apparatus defined in claim 1 wherein combustor (8) operates at substantially atmospheric pressure.

* * * * *